United States Patent [19]

Yamashita et al.

[11] Patent Number: 4,855,541

[45] Date of Patent: Aug. 8, 1989

[54] ELECTRONIC COMPONENT HAVING IMPROVED ROTARY SWITCH DETENT SPRING CONSTRUCTION AND IMPROVED TERMINAL SEAL STRUCTURE

[75] Inventors: Masatsugu Yamashita, Osaka; Norio Iwakiri, Kyoto; Sekisuke Yamanaka, Shizuoka; Akira Yanase, Osaka, all of Japan

[73] Assignee: Omron Tateisi Electronics Co., Kyoto, Japan

[21] Appl. No.: 105,791

[22] Filed: Oct. 8, 1987

[30] Foreign Application Priority Data

Oct. 8, 1986 [JP] Japan ..... 61-154518[U]
Nov. 7, 1986 [JP] Japan ..... 61-171134[U]

[51] Int. Cl.[4] ..... H01H 19/00; H01H 1/58

[52] U.S. Cl. ..... 200/6 R; 200/6 B; 200/6 BB; 200/565

[58] Field of Search ..... 200/5 R, 6 R, 6 B, 6 BA, 200/6 BB, 6 C, 11 R, 11 G, 11 J, 11 K, 11 TW, 153 L, 153 LA, 153 LB, 291, 302.1, 336, 564–573

[56] References Cited

U.S. PATENT DOCUMENTS

| | | | |
|---|---|---|---|
| 4,260,860 | 4/1981 | Niihama et al. | 200/6 R |
| 4,400,597 | 8/1983 | Bruder et al. | 200/6 B |
| 4,504,706 | 3/1985 | Watanabe et al. | 200/6 R X |
| 4,527,023 | 7/1985 | Ohashi et al. | 200/11 K X |
| 4,539,444 | 9/1985 | Senoh | 200/5 A |
| 4,551,587 | 11/1985 | Rose | 200/11 R |

FOREIGN PATENT DOCUMENTS

| | | |
|---|---|---|
| 2302453 | 8/1974 | Fed. Rep. of Germany . |
| 1258350 | 12/1971 | United Kingdom . |

*Primary Examiner*—J. R. Scott
*Attorney, Agent, or Firm*—Wegner & Bretschneider

[57] ABSTRACT

This electronic component of the rotary switch type may include: a casing; a disk shaped rotor, rotatably supported in the casing, and formed with a cam pattern system; a contact system which is actuated by the cam pattern system as the rotor is rotated; and a sheet spring. The sheet spring has: two pressure portions; a substantially flat portion, intermediate between the two pressure portions, which is stressed so as to press the two pressure portions against the cam pattern system as the rotor is rotated, for providing detent action for the rotor; and a fixing portion, fixed to the casing, and proximate and connected to the substantially flat portion. There may be two each of the substantially flat portion and the fixing portion. As a specialization, this sheet spring may be generally ring shaped with a generally circular interior outline and a generally square exterior outline, and its two pressure portions may be two of its diagonally opposed corner portions which are creased so as to define projections opposing the cam pattern system, while its two substantially flat portions may be the other two of its diagonally opposed corner portions which are creased so as to press its two pressure portions against the cam pattern system. Also, this electronic component may include a resin casing with a terminal passing through it and a hole formed through it from its surface to the terminal, with some thermosetting bonding agent filled into the hole and sealing the terminal to the casing.

16 Claims, 5 Drawing Sheets

ELECTRONIC COMPONENT HAVING IMPROVED ROTARY SWITCH DETENT SPRING CONSTRUCTION AND IMPROVED TERMINAL SEAL STRUCTURE

BACKGROUND OF THE INVENTION

The present invention relates to an electronic component, and particularly to an electronic component which is a rotary switch which has an improved type of detent spring construction, so that the detent action for said rotary switch can be stronger and more positive than heretofore practicable. In another aspect, the present invention relates to such an electronic component, incorporating a casing made of resin such as synthetic resin, which has an improved sealing construction which positively prevents ingress of soldering flux, during the process of soldering said electronic component to a printed circuit board, through a space around a terminal member which is passed through said resin casing.

In the prior art, there have been proposed various types of rotary switch type electronic components, such as so called rotary DIP switches. Such rotary switch type electronic components have typically included a disk shaped rotor member which can be rotated from the outside to actuate the rotary switching action. Typically, in such a construction, when this disk shaped rotor member is rotated, irregularities formed on its surface (either on one of its end surfaces or on its circumferential surface) drive various movable contacts to and fro, so as to make or to break various electrical or electronic circuits. Also, typically, a detent action has been provided for such rotary switching action; i.e., a detent mechanism has been provided for giving a stepwise clicking feeling to the turning action of the disk shaped rotor member, and for preferentially indexing said turning action of said rotor member to particular rotary positions. A typical prior art detent mechanism, which includes a sheet spring, will now be explained with regard to FIG. 1 of the appended drawings, which is a view of a portion of the casing of the rotary switch in which said prior art sheet spring is housed, and sheet spring being shown in plan view.

Referring to FIG. 1, the reference numeral 14 denotes a portion of the casing of this prior art rotary switch, while the reference numeral 34 denotes a disk shaped rotor member which is rotatably supported within said casing portion 14. It should be noted that the diameter of the rotor member 34 is greater than the diameter of that circular portion thereof which is visible in FIG. 1; and in fact that one of the end surfaces of this rotor member 34 which faces the viewer from the point of view of FIG. 1 is formed on its radially extreme circumferential portion—which is in fact hidden in the FIG. 1 view by the sheet spring member 10 to be described shortly—with wavy irregularities not shown in the figure. At this rotor member 34 is rotated about its rotational axis which is perpendicular to the plane of the FIG. 1 drawing paper, by a mechanism not shown in the figure said rotor member 34 opens and/or closes various contacts to provide switching action.

A detent mechanism is provided for the rotatory action of this rotor member 34, comprising a sheet spring member 10 which is shown in plan view in FIG. 1, in a position fixed to a switch casing 14 of this prior art rotary switch and ready for being pressed (in the direction forward out of the drawing paper in FIG. 1) against the radially outer circumferential portion of the rotor member 34 and against the wavy irregularities formed on said rotor member outer circumferential portion. This sheet spring member 10 is formed with an approximately square external outline, with two circular openings 52 each of which is formed in one of two substantially flat portions denoted as "F", each of which substantially flat portions "F" including one of a diagonally opposing pair of corners of said square external outline. Said openings 52 fall near said diagonally opposing pair of corners, with an approximately circular internal outline which is substantially concentric with said square external outlet. Further, the three dimensional shape of said sheet spring member 10 (not particularly shown in the drawings) is as follows: the diagonally opposed pair of portions "F" including one diagonally opposed pair of corners of the sheet spring member 10 are substantially flat and are not distorted substantially out of the plane of the drawing paper, except that each of them is formed with two very slight creases denoted as **15*a*1 and 15*a*2, and 15*b*1 and 15*b*2, which serve to slightly angle the two portions which constitute the major portion of the remainder of the sheet spring member 10 as a whole in the direction towards the viewer from the point of view of FIG. 1; while each of the other diagonally opposed pair of portions, denoted as 12*a* and 12*b* and including the other diagonally opposed pair of corners of the sheet spring member 10, is formed with three obutsely angled creases denoted as 13*a*1, 13*a*2, and 13*a*3 for the portion 12*a* and as 13*b*1, 13*b*2, and 13*b*3 for the portion 12*b*. The obtuse angles of the creases 13*a*1 and 13*b*1 face away from the viewer from the point of view of FIG. 1, while on the other hand the obtuse angles of the creases 13*a*2, 13*a*3, 13*b*2, and 13*b*3 face towards the viewer from the point of view of FIG. 1. Thereby, each of these diagonally opposed portions 12*a* and 12*b* of the sheet spring member 10 is formed in a shallow V shape, with the apexes or points of these V shapes being constituted by the obtusely angled creases 13*a*1 and 13*b*1 and each being displaced forwardly from the drawing paper with respect to the remainder of its portion 12*a* or 12*b* from the point of view of FIG. 1. Now, through the openings 52 formed in the other substantially flat diagonally opposed portions "F" of the sheet spring member 10 there are passed fixing pins 16*a* and 16*b* formed as projecting towards the viewer from the point of view of FIG. 1 from the surface of the switch casing 14, and these fixing pins 16*a* and 16*b* are thermally crimped over so as to securely and fixedly attach these portions "F" of the sheet spring member 10 to this surface of the switch casing 14. In this position, when the rotary switch is assembled and the rotor member 34 is pressed from the front, from the point of view of FIG. 1, with the wavy irregularities formed on the radially extreme circumferential portion of said rotor member 34 being on the side of said rotor member 34 which is turned away from the viewer, so that as said wavy irregularities are pressed against said sheet spring member 10, the apexes 13*a*1 and 13*b*1 of the V shapes formed in the diagonally opposed portions 12*a* and 12*b* of the sheet spring member 10 are forcibly pressed against said radially extreme circumferential portion of the rotor member 34 and against said wavy irregularities formed therein, creating some distortion of these portions 12*a* and 12*b* of the sheet spring member 10 in the direction away from the viewer from the point of view of FIG. 1, and of said sheet spring member 10 as a whole, being forced at this time. Thus, as the rotor member 34 is turned, by the indexing action of these wavy irregularities thereof against these apexes 13*a*1 and 13*b*1 of the V shapes of the diagonally opposed portions 12***a* and 12*b* of the sheet spring member 10, a stepwise clicking or detent action is provided for this rotary motion, with said apexes 13*a*1 and 13*b*1 clicking into the depressed portions of these wavy irregularities by the spring action of the sheet spring member 10, thus defining preferential rotational positions for the rotor member 34, into which said rotor member 34 tends to be retained during its rotational action.

However, this construction is subject to the following problem. Namely, the stress set up in the sheet spring member 10 by the above explained distortion of said sheet spring member 10 in the direction away from the viewer from the point of view of FIG. 1 tends to be concentrated in the substantially flat diagonally opposed portions "F" of the sheet spring member 10, which are intermediate between the V shape apexes 13*a*1 and 13*b*1 of the diagonally opposed portions sheet spring portions 12*a* and 12*b*, and accordingly, with the other constructional parameters remaining the same, as the area of these substantially flat diagonally opposed portions "F" is increased, the maximum level of the stress in said substantially flat diagonally opposed portions "F" is decreased. In other words, for a determinate maximum possible level of stress in said substantially flat diagonally opposed portions "F" (this maximum possible stress level being fixed according to the material and the thickness of the sheet spring member 10), the greater the area of the substantially flat diagonally opposed portions "F", the greater the usable spring action available from the sheet spring member 10, and accordingly the greater the detent action available from this rotary switch as a whole. And plainly it is desirable to maximize the effectiveness of this detent action. However, since the fixing pins 16*a* and 16*b* for fixing the sheet spring member 10 to the switch casing 14, in this conventional illustrated construction, pass through said substantially flat diagonally opposed portions "F", the area of said substantially flat diagonally opposed portions "F" is thereby restricted, and accordingly the usable spring action available from the sheet spring member 10 is restricted, and the detent action available from this rotary switch as a whole is restricted. At worst, this can cause improper action and improper contact setting function of this rotary switch. To avoid such a problem, the sheet spring member 10 and the rotary switch as a whole may be constructed more solidly than might be strictly required if the constructional scheme were more favorable. Such unduly solid construction is costly and creates an unduly heavy and bulky switch.

Another matter relating to the construction of an electronic component will now be discussed with regard to FIG. 2 of the appended drawings, which also relates to the prior art. FIG. 2 is a sectional view showing how in a typical conventional case, the terminals for electrical connection to the outside are led through the material of the casing of an electronic component by being insert molded thereinto. In detail, as a matter of course an electronic component which is intended for being mounted to a printed circuit board comprises one or more terminals which extend from the interior of said electronic component to the outside thereof, typically passing through a casing of said electronic component, said casing typically being formed of a resin material such as a synthetic resin material. Now, during the process of fixing such an electronic component to a printed circuit base board, it is usual that the end portions of these terminals should be soldered to electrically conductive portions of a printed circuit pattern which is impressed on said printed circuit base board, and this soldering process is typically performed with the aid of the application of a soldering flux type material. It is very desirable, in fact it is essential, that this soldering flux is not allowed to penetrate into the interior of the casing of the electronic component during the soldering process. According to the conventional art as exemplarily shown in FIG. 2, the terminal members such as 20 of the electronic component were insert molded into the body 18 of the electronic component during the manufacture of said electronic component body 18 from synthetic resin by a molding process, and accordingly inner portions such as 20*a* of said terminal members 20 were embedded in and were enclosed by synthetic resin in the finished product. The close adhesion of the material of the electronic component body 18 to the inner terminal portions 20*a* prevents the intrusive penetration of soldering flux into the interior of the casing of the electronic component during the process of soldering the terminal members 20 to a printed circuit pattern on a printed circuit base board.

However, with this type of prior art construction, the problem tends to arise that, since there is typically a large difference between the coefficient of thermal expansion of the terminal member material (typically a metal) and the coefficient of thermal expansion of the electronic component body material (typically a synthetic resin) and since inevitably these terminal members 20 and also the proximate portions to said terminal members 20 of the material of said electronic component body 18 are considerably heated up during the above described soldering process, differential expansion between these members can cause gaps to open up between them, and a possibility exists of soldering flux creeping into the interior of the electronic component body 18 through these opened up gaps. This caused problems with the reliability of such electronic components, due to problems with bad contacts and the like engendered by such soldering flux ingress.

SUMMARY OF THE INVENTION

Accordingly, there has become evident a requirement for an improved electronic component. This problem has exercised the ingenuity of the inventors of the present invention.

Thus, it is the primary object of the present invention to provide an electronic component, which avoids the various problems detailed above.

It is a further object of the present invention to provide such an electronic component, being a rotary switch, which has a construction which provides a good detent action.

It is a further object of the present invention to provide such an electronic component, being a rotary switch, which has a construction in which the stress bearing capability of such a sheet spring member is more effectively and efficiently utilized than in the prior art discussed above.

It is a further object of the present invention to provide such an electronic component, being a rotary switch, which has a construction in which such a sheet spring member is more effectively and efficiently mounted to the casing of the switch than in the prior art discussed above.

It is a further object of the present invention to provide such an electronic component, being a rotary switch, which is not required to be constructed in an unduly robust fashion.

It is a further object of the present invention to provide such an electronic component, being a rotary switch, which is not unduly costly.

It is a further object of the present invention to provide such an electronic component, being a rotary switch, which is not unduly large.

It is a further object of the present invention to provide such an electronic component, being a rotary switch, which is not unduly heavy.

It is a yet further object of the present invention to provide such an electronic component, which is well and effectively sealed.

It is a yet further object of the present invention to provide such an electronic component, which is sealed so well so as to not to lose its seal, even when its terminals are heated up as during soldering of said terminals to a printed circuit board.

It is a yet further object of the present invention to provide such an electronic component, which can maintain good performance without deterioration of its operational characteristics occurring due to the ingress of soldering flux.

It is a yet further object of the present invention to provide such an electronic component, which is not liable to the occurrence of poor contact performance.

According to the most general aspect of the present invention, these and other objects are attained by a rotary switch type electronic component, comprising: (a) a casing; (b) a disk shaped rotor member, rotatably supported in said casing, and formed with a cam pattern system; (c) a contact system which is actuated by said cam pattern system formed on said disk shaped rotor member as said disk shaped rotor member is rotated; and: (d) a sheet spring, comprising: (d1) two pressure portions; (d2) a substantially flat portion, intermediate between said two pressure portions, which is stressed so as to press said two pressure portions against said cam pattern system formed on said disk shaped rotor member as said disk shaped rotor member is rotated, for providing detent action for said disk shaped rotor member; and: (d3) a fixing portion, fixed to said casing, and proximate and connected to said substantially flat portion. Alternatively, these and other objects may be attained by a rotary switch type electronic component, comprising: (a) a casing; (b) a disk shaped rotor member, rotatably supported in said casing, and formed with a cam pattern system; (c) a contact system which is actuated by said cam pattern system formed on said disk shaped rotor member as said disk shaped rotor member is rotated; and: (d) a sheet spring, comprising: (d1) two pressure portions; (d2) two substantially flat portions, each intermediate between said two pressure portions, which are stressed so as to press said two pressure portions against said cam pattern system formed on said disk shaped rotor member as said disk shaped rotor member is rotated, for providing detent action for said disk shaped rotor member; and: (d3) two fixing portions, each fixed to said casing, and each proximate and connected to a corresponding one of said substantially flat portions. In this case, the construction may further be that the sheet spring is generally ring shaped with a generally circular interior outline and a generally square exterior outline, and said two pressure portions thereof are constituted by a pair of two diagonally opposed corner portions thereof which are creased so as to define projections opposing said cam pattern system formed on said disk shaped rotor member, while said two substantially flat portions thereof are constituted by the other pair of two diagonally opposed corner portions thereof which are creased so as to press said two pressure portions thereof against said cam pattern system formed on said disk shaped rotor member. As a specialization, the fixing portion or portions of said sheet spring may be connected to said substantially flat portion or portions thereof by a narrowed portion or portions; and a notch or notches may be defined on one side of said narrowed portion or portions of said sheet spring between said fixing portion or portions thereof and said substantially flat portion or portions thereof. The fixing portion or portions may be formed with an aperture or apertures by which it or they is or are fixed to the casing; and, in such a case, said fixing portion or portions may be fixed to said casing by thermal crimping, or by press fitting, or by snap fitting.

According to such an electronic component as just specified above, since the substantially flat portion or portions of the sheet spring need not to be used for fixing said sheet spring to the casing of the electronic component—since the fixing portions are used for that purpose—accordingly said substantially flat sheet spring portion or portions need not to be pierced with any apertures such as openings or the like, but instead may be left continuous, and thereby accordingly the stress set up in the sheet spring by distortion of said sheet spring during the performance of its springing action, which as explained earlier in this specification tends to be concentrated in said substantially flat sheet spring portion or portions, is much better able to be distributed, than was the case with the sheet spring formed according to the prior art as described earlier in this specification and as shown in FIG. 1. Accordingly it will be easily understood that, with the other constructional parameters of this rotary switch type electronic component remaining the same, since relative to the prior art the area of the substantially flat portion or portions is effectively much increased, the maximum level of the stress in said substantially flat portion or portions is decreased. In other words, for a determinate maximum possible level of stress in said substantially flat portion or portions, this maximum possible stress level being fixedly determined according to the material and the thickness of the sheet spring, a much greater usable spring action is available from the sheet spring, since the effective area of the substantially flat portion or portions is much greater and further is more effectively and efficiently utilized (since no fixing function is required from said substantially flat portion or portions), and accordingly the greater is the detent action available from this rotary switch as a whole. Accordingly it is possible to maximize the effectiveness of this detent action, thus preventing any liklihood of improper action or of improper contact setting function of this rotary switch; and this has been done without it being required to construct the sheet spring or the rotary switch as a whole particularly more solidly or strongly than heretofore. Accordingly this construction according to the present invention does not entail any particularly severe increases in cost, weight or bulk.

If the notch or notches as described above are provided between the sheet spring fixing portion or portions and its substantially flat portion or portions, because this notch or notches further isolates the stress bearing function of said substantially flat portion or portions from the function of the fixing portions of fixing the sheet spring to the casing the substantially flat portion or portions provide even less concentrated and more uniform overall stress bearing action.

And, according to another aspect of the present invention, the above and other objects may be accomplished by an electronic component, comprising a resin casing and a terminal member passing through said resin casing between its inside and its outside, a hole being formed through said resin casing from a surface portion thereof to an interior point thereof which reaches said terminal member, and a quantity of thermosetting bonding agent being filled into said hole and sealing said terminal member to said casing.

According to such an electronic component as just specified above, during the process of fixing it by soldering to a printed circuit base board, inevitably the terminal member and also the proximate portions to said terminal member of the material of the resin casing are considerably heated up during the soldering process. However, no substantial possibility can occur of soldering flux creeping into the interior of the resin casing through any gap that might open up between the material of the terminal member and the material of the resin casing, because the thermosetting bonding agent material has already been infiltrated into any such gap. Accordingly, the intrusion of soldering flux or the like into the interior of this electronic component is prevented. This means that there is no substantial likelihood of the occurrence of any problems with the reliability of such an electronic component, due to problems with bad contacts or the like engendered by such soldering flux ingress. Thus, it is seen that this electronic component is well and effectively sealed, and is not liable to lose its seal, even when its terminals are heated up as during soldering of said terminals to a printed circuit board. Further, this electronic component can maintain good performance without deterioration of its operational characteristics occurring due to the ingress of soldering flux, and is not likely to have problems with poor contact performance.

BRIEF DECRIPTION OF THE DRAWINGS

The present invention will now be described with respect to the preferred embodiments thereof, and with reference to the illustrative drawings appended hereto, which however are provided for the purposes of explanation and exemplification only, and are not intended to be limitative of the scope of the present invention in any way, since this scope is to be delimited solely by the accompanying claims. With relation to the figures, spatial terms are to be understood as referring only to the orientation on the drawing paper of the illustrations of the relevant elements, unless otherwise specified; like reference symbols, unless otherwise so specified, denote the same parts and spaces and so on in the various figures relating to one preferred embodiment, and like parts and spaces and so on in figures relating to different preferred embodiments; and:

FIG. 1, which relates to the prior art, is a plan view showing a portion of the casing of a rotary switch, housing a sheet spring of a per se conventional type which is used for providing detent action for the rotary switching action of said prior art rotary switch;

FIG. 2, which also realtes to the prior art, is a sectional view showing how in a typical conventional case terminals for electrical connection to the outside are led through the material of the casing of an electronic component by being insert molded thereinto;

FIG. 3 is an exploded perspective view showing the principal portions of the first preferred embodiment of the rotary switch type electronic component of the present invention;

FIG. 4 is a plan view, similar to FIG. 1 which related to the prior art but now relating to said first preferred embodiment of the rotary switch type electronic component of the present invention, showing a portion of the casing of said first preferred embodiment rotary switch housing a sheet spring of a novel type for providing a detent action for this first preferred embodiment rotary switch, said sheet spring being in this first preferred embodiment fixed to the casing by thermal crimping;

FIG. 5 is a plan view, similar to FIGS. 1 and 4 which respectively related to the prior art and to the first preferred embodiment of the present invention, but relating to the second preferred embodiment of the rotary switch type electronic component of the present invention, again showing a portion of the casing of said second preferred embodiment rotary switch housing such a detent action sheet spring, said sheet spring being in this second preferred embodiment fixed to the casing by press fitting;

FIG. 6 is a pan view, similar to FIGS. 1, 4, and 5 which respectively related to the prior art and to the first and the second preferred embodiments of the present invention, but relating to the third preferred embodiment of the rotary switch type electronic component of the present invention, again showin a portion of the casing of said third preferred embodiment rotary switch housing such a detent action sheet spring, said sheet spring being in this third preferred embodiment fixed to the casing by snap fitting;

FIG. 7 is a sectional view of the switch base member of this first preferred embodiment of the rotary switch type electronic component of the present invention, taken in a plane shown by the arrows VII—VII in FIG. 3, and similar to FIG. 2 which however related to the prior art, showing how in this case terminals for electrical connection to the outside are led through the material of the casing of this first preferred embodiment electronic component by being insert molded thereinto, which a sealing plug of thermosetting bonding agent now being additionally utilized;

FIG. 8 is a view from underneath of this switch base member of the first preferred embodiment, showing how several such thermosetting bonding agent sealing plugs are in fact utilized.

DESCRIPTION OF THE PREFERRED EMBODIMENTS

The present invention will now be described with reference to the preferred embodiments thereof, and with reference to the figures.

THE FIRST PREFERRED EMBODIMENT

Figure 3:
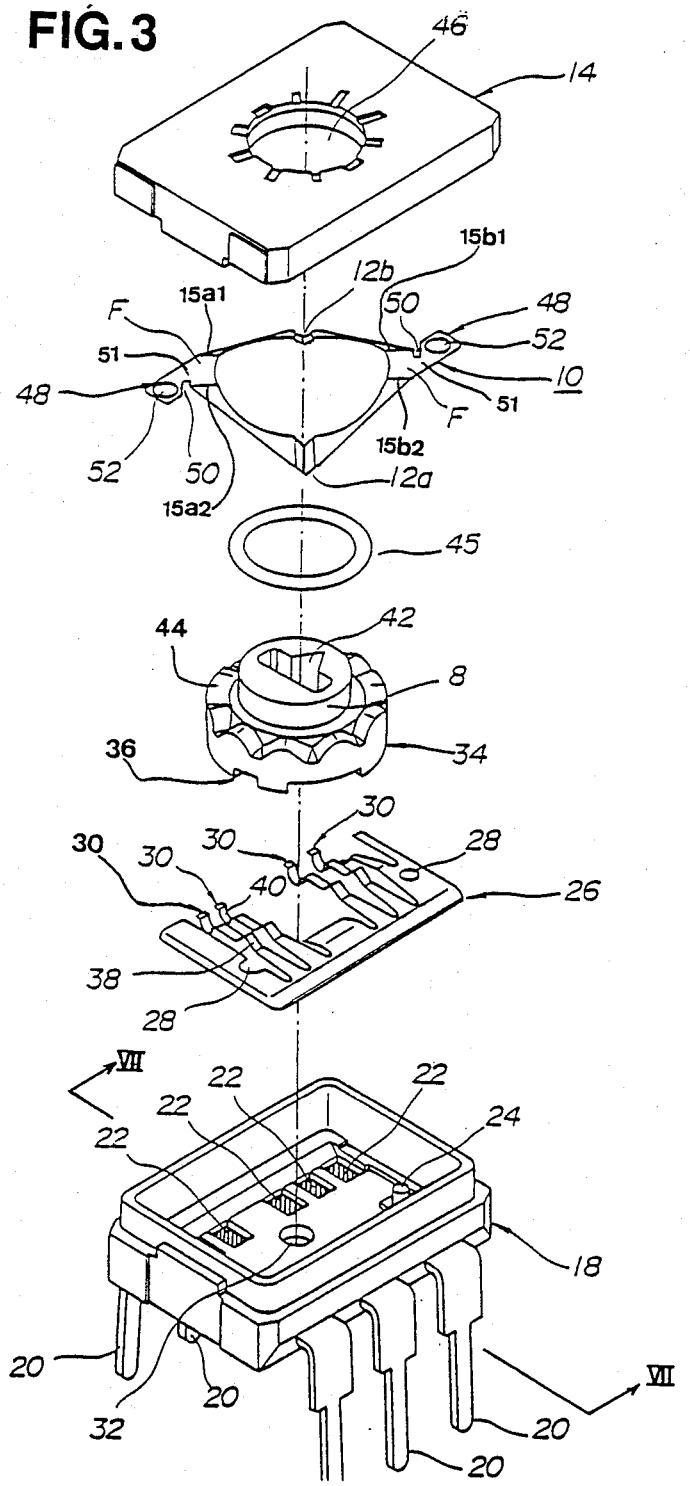

FIG. 3 is an exploded perspective view showing the principal portions of the first preferred embodiment of the rotary switch type electronic component of the present invention. In this figure, the reference numeral 14 denotes a cover member for this rotary switch, and the reference numeral 18 denotes a base member thereof. The switch cover member 14 is fitted securely to the switch base member 18, when the switch is assembled, with the other parts of the switch enclosed and held between them.

There are provided a plurality of terminal members 20 which are embedded in and pass through the material of the switch base member 18, as will be more particularly described later, and exterior portions of which are projected to the outside of the rotary switch and are bent over, so to be connected to a printed circuit board to which this rotary switch is to be fitted. Inner end portions, not particularly shown in this FIG. 3, of this plurality of terminal members 20 are connected to or, in this particular case, constitute a plurality of fixed contact members 22, which are exposed on the inner surface of the switch base member 18 at apropriate positions, as will be described hereinafter; these positions, in this particular preferred embodiment of the present invention, are arranged along a line. Further, two fixing pins 24 are formed from the material of the switch base member 18 and protrude upwards in the figure from its inner surface, and further at a generally central position on said inner surface of said switch base member 18 there is formed a circular depression or socket 32 which is for serving as a bearing hole.

A contact plate 26 is formed in the general configuration of a comb, and the projections 30 thereof (there are in all four such projections 30, in the shown exemplary embodiment) are crinkled to and fro, so as to define upwardly projecting intermediate drive bumps 38 at their intermediate portions and movable contact portions 40 at their free ends which are bent round into upwardly opening letter "U" shapes. Further, two fixing apertures 28 are formed in said contact plate 26. During assembly of this rotary switch, the contact plate 26 is placed over the switch base member 18 with the fixing pins 24 of said switch base member 18 fitting into the fixing apertures 28 of said contact plate 26, and then the ends of the fixing pins 24 are crimped as for example by thermal crimping, so that the contact plate 26 is securely fitted in place over the switch base member 18. In this state, each of the movable contact portions 40 opposes an appropriate one of the fixed contact members 22, being, in the unstressed state of the contact plate 26 and of the projections 30, separated from said one of said fixed contact members 22 by a certain gap.

The reference numeral 34 denotes a disk shaped rotor member which is rotatably supported between the switch cover member 14 and the switch base member 18. The lower surface of this rotor member 34 from the point of view of FIG. 3 is formed on it radially outer circumferential portion—only slightly visible in the FIG. 3 view—with a wavy irregular pattern denoted as 36 but not clearly or completely shown in the figures. Further, at the center of this lower surface of this rotor member 34 from the point of view of FIG. 3 there is provided a stub shaft, not shown in the figures. The upper surface of this rotor member 34 from the point of view of FIG. 3 is formed on its radially outer circumferential portion with a wavy irregular pattern denoted as 44, which is used for providing detent action as will be explained hereinafter, while its central portion is formed as a raised disk portion denoted as 8, in the center of the upper surface of which a slot 42 suitable for receiving the tip of a screwdriver is formed. When this rotary switch is assembled, the downwardly extending (from the point of view of FIG. 3) stub shaft thereof is rotatably fitted into the bearing hole socket 32 formed as described above on the inner surface of the switch base member 18. Then, as the switch cover member 14 is fitted over said switch base member 18, the raised disk portion 8 of said rotor member 34 is rotatably fitted into a correspondingly shaped and sized circular aperture 46 formed in said switch cover member 14, with a sealing O ring denoted as 45 interposed therebetween. Thereby the rotor member 34 is rotatably supported within the body of the rotary switch and can conveniently be turned about its central axis by a user fitting the tip of a screwdriver into the slot 42 and turning said screwdriver. When this is done, as the rotor member 34 is rotated about its rotational axis, at each of various preferred positions thereof which are defined as will be explained hereinafter, the wavy irregular pattern 36 formed on the lower surface of said rotor member 34 from the point of view of FIG. 3 pushes as appropriately arranged on appropriate ones of the intermediate drive bumps 38 of the projections 30 of the contact plate 26 and does not push on other appropriate ones of said intermediate drive bumps 38. This action causes appropriate ones of the movable contact portions 40 to be pushed down at the ends of said projections 30 so as to contact with the corresponding ones of the fixed contact members 22 but prevents other appropriate ones of said movable contact portions 40 from being pushed down to contact with their corresponding ones of said fixed contact members 22. In this way, appropriate electrical connections are made between the various terminal members 20 of this rotary switch, according to the particular rotational position thus imparted by the user to the rotor member 34—in other words, a digital signal is made available at said terminal members 20. This type of rotary switch can be used, for examle, as a rotary DIP switch, or for some other application.

Figure 4:
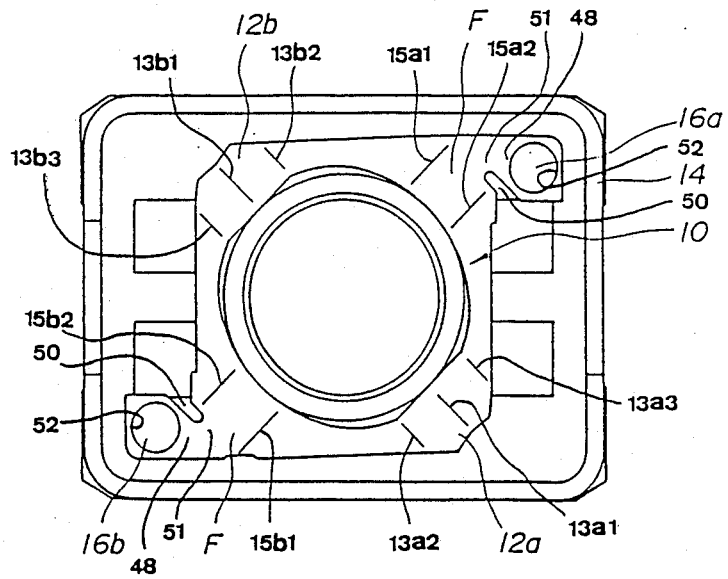

Now the detent mechanism which is provided for the rotary action of the rotor member 34 will be explained. This detent mechanism comprises a sheet spring member 10 which is sandwiched between the upper face from the point of view of FIG. 3 of the rotor member 34 and the lower surface of the switch cover member 14. This sheet spring member 10 is shown in perspective view in FIG. 3, while being shown in plan view in FIG. 4, from the point of view of which figure it lies in front of the radially outer circumferential portion of the rotor member 34 and hides the wavy irregularities 44 formed on the outer circumferential portion of said rotor member 34. This sheet spring member 10 is formed with an approximately square external outline, except that, from each of two substantially flat portions denoted as "F" each of which includes one of a diagonally opposing pair of corners of said square external outline, there extends a mounting ear portion denoted as 48 connected to the main body of the sheet spring member 10 by a narrow connecting bridge portion denoted as 51, on the one side of which there is defined a notch shape 50. Each of these mounting ear portions 48 is formed with a circular opening 52. Further, the sheet spring member 10 is formed with an approximately circular internal outline which is substantially concentric with its general square external outline, and which fits over the raised disk portion 8 of the rotor member 34. Further, the three dimensional shape of this sheet spring member 10, not particularly shown in FIG. 4 but generally visible in FIG. 3, is as follows: the diagonally opposed pair of portions "F" thereof, including one diagonally opposed pair of corners of the sheet spring member 10, are substantially flat and are not distorted substantially out of the plane of the drawing paper of FIG. 4, except that each of them is formed with two very slight creases denoted as 15*a*1 and 15*a*2, and 15*b*1 and 15*b*2. These creases serve to slightly angle the two portions which constitute the major portion of the remainder of the sheet spring member 10 in the direction towards the viewer from the point of view of FIG. 4; while each of the other diagonally opposed pair of portions, denoted as 12*a* and 12*b* and including the other diagonally opposed pair of corners of the sheet spring member 10, is formed with three obtusely angled creases denoted as 13*a*1, 13*a*2, and 13*a*3 for the portion 12*a* and as 13*b*1, 13*b*2, and 13*b*3 for the portion 12*b*. The obtuse angles of the creases 13*a*1 and 13*b*1 face away from the viewer from the point of view of FIG. 4, while the obtuse angles of the creases 13*a*2, 13*a*3, 13*b*2, and 13*b*3 face towards the viewer from the point of view of FIG. 4. Thereby, each of these diagonally opposed portions 12*a* and 12*b* of the sheet spring member 10 is formed in a shallow V shape, with the apexes or points of these V shapes being constituted by the obtusely angled creases 13*a*1 and 13*b*1 and each being displaced in the direction forward from the drawing paper with respect to the remainder of its portion 12*a* or 12*b* from the point of view of FIG. 4 and in the direction pointing downwards from the point of view of FIG. 3. Now, through the openings 52 formed in the mounting ear portions 48 there are passed fixing pins 16*a* and 16*b* projecting towards the viewer from the point of view of FIG. 4 from on the lower surface of the switch casing 14 as seen in FIG. 3, and these fixing pins 16*a* and 16*b* are, in this first preferred embodiment of the present invention, thermally crimped over so as to securely and fixedly attach these mounting ear portions 48 and thereby the sheet spring member 10 to this surface of the switch casing 14. In this position, when the rotary switch is assembled as described earlier, the apexes 13*a*1 and 13*b*1 of the V shapes formed in the diagonally opposed portions 12*a* and 12*b* of the sheet spring member 10 are forcibly pressed against the radially extreme circumferential portion of the upper surface as seen in FIG. 3 of the rotor member 34 and against the wavy irregularities 44 formed thereon, causing some distortion of these portions 12*a* and 12*b* of the sheet spring member 10 in the direction away from the viewer from the point of view of FIG. 4 and of said sheet spring member 10 as a whole. Thus, as the rotor member 34 is turned, by the indexing action of these wavy irregularities 44 thereof against these apexes 13*a*1 and 13*b*1 of the V shapes of the diagonally opposed portions 12*a* and 12*b* of the sheet spring member 10, a stepwise clicking or detent action is provided for this rotary motion, with said apexes 13*a*1 and 13*b*1 clicking into the depressed portions of these wavy irregularities by the spring action of the sheet spring member 10, thus defining preferential rotational positions for the rotor member 34 into which said rotor member 34 tends to be retained during its rotational action; and, provided that the dimensions of the various members are appropriate, these preferential positions of the rotor member 34 will be the ones described above, at which said rotor member 34 performs its various required switching actions for the movable contacts 30 against the fixed contact members 22.

Figure 1:
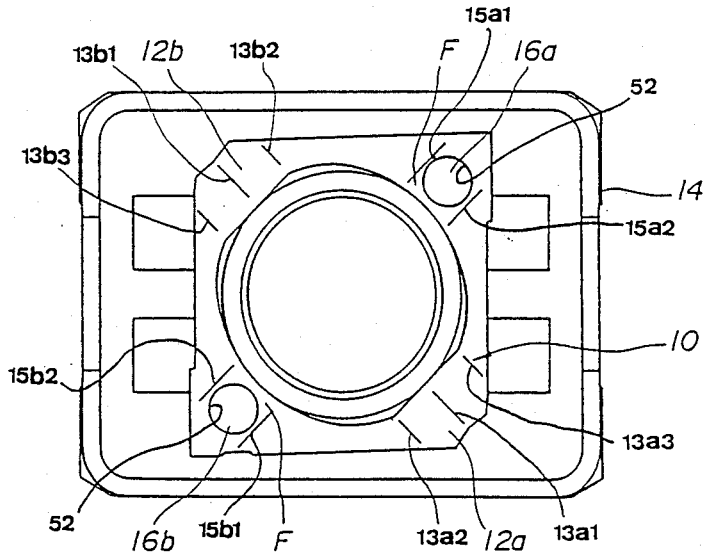
FIG.1 PRIOR ART

According to this construction according to the first preferred embodiment of the rotary switch type electronic component of the present invention, because the substantially flat diagonally opposed portions "F" of the sheet spring member 10, which are intermediate between the V shape apexes 13*a*1 and 13*b*1 of the diagonally opposed portions sheet spring portions 12*a* and 12*b* are not pierced with any apertures such as the opening 52 but instead are continuous—which is accomplished by performing the mounting of said sheet spring member 10 by fixing the mounting ear portions 48, which are separate portions from said portions "F", to the material of the switch cover member 14—thereby stress is set up in the sheet spring member 10 by the above explained distortion of said sheet spring member 10 in the direction away from the viewer from the point of view of FIG. 1, which as explained above tends to be concentrated in said substantially flat diagonally opposed portions "F"0 of the sheet spring member 10, is much better able to be distributed than was the case with the spring member formed according to the prior art as described earlier in this specification and as shown in FIG. 1. Accordingly it will be easily understood that, with the other constructional parameters of the rotary switch remaining the same, the area of these substantially flat diagonally opposed portions "F" is greatly increased and the maximum level of the stress in said substantially flat diagonally opposed portions "F" is decreased. In other words, for a determinate maximum possible level of stress in said substantially flat diagonally opposed portions "F", this maximum possible stress level being fixedly determined according to the material and the thickness of the sheet spring member 10, a much greater usable spring action is available from the sheet spring member 10, since the effective area of the substantially flat diagonally opposed portions "F" is much greater and further is more effectively and efficiently utilized (since no noles are pierced through said diagonally opposed portions "F" and further no portions of said diagonally opposed portions "F" are fixed to the switch cover member 14), and accordingly the detent action available from this rotary switch as a whole is greater. Accordingly it is possible to maximize the effectiveness of this detent action, thus preventing any likelihood of improper action or of improper contact setting function of this rotary switch; and this has been done without it being required to construct the sheet spring member 10 and the rotary switch more solidly than heretofore. Accordingly this construction according to this first preferred embodiment of the rotary switch type electronic component of the present invention does not cause significant increases in cost, weight or bulk.

A further benefit of the shown first preferred embodiment construction is attained by the provision of the notches 50 which are present between the mounting ear portions 48 and the diagonally opposed portions "F" of the sheet spring member 10. This construction because this further isolates the stress bearing function of said diagonally opposed portions "F" from the function of said mounting ear portions 48 of fixing the sheet spring member 10 to the switch cover member 14, thereby further allowing less concentrated and more uniform and therefore overall greater stress bearing action to be provided by said diagonally opposed portions "F".

Figure 7:
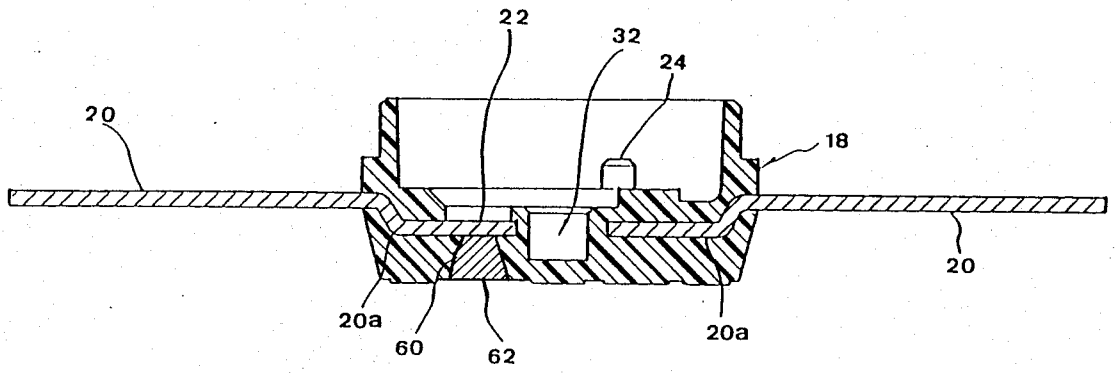
FIG.7 PRIOR ART
Figure 2:
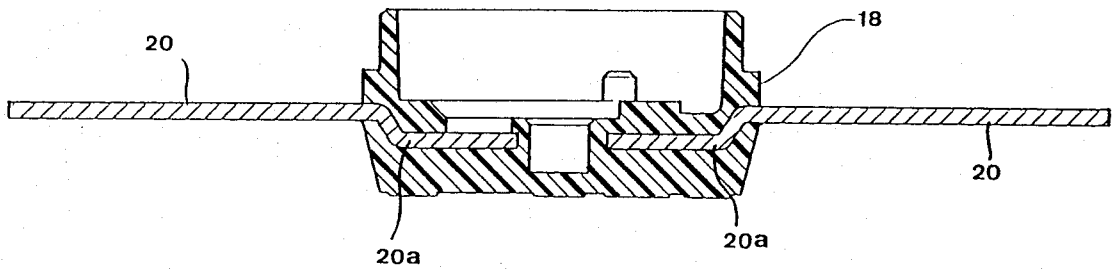

Now, another aspect to this construction according to this first preferred embodiment of the rotary switch type electronic component of the present invention will be described, with reference to FIGS. 7 through 10 of the figures. FIG. 7 is a sectional view of the switch base member 18 of this first preferred embodiment of the rotary switch type electronic component of the present invention, taken in a plane shown by the arrows VII- —VII in FIG. 3, and is similar to FIG. 2 described above with reference to the prior art. It should be understood that the switch base member 18 and the switch cover member 14 are, in this first preferred embodiment, both formed from synthetic resin.

The terminal members 20, as described previously, are embedded in and pass through the material of the switch base member 18, and their exterior portions project to the outside of the rotary switch and are bent over, so as to be connected to a printed circuit board, not particularly shown, to which this rotary switch is to be fitted. In this construction, the inner end portions of the terminal members 20 constitute the fixed contact members 22, as previously described.

Further, a hole 60 is formed through the material of the switch base member 18 from the outside to one of the terminal members 20 and a quantity 62 of a thermosetting bonding agent is filled into this hole 60. As can be seen from FIG. 10, which is a view from underneath of this switch base member 18, in fact several such thermosetting bonding agent sealing plugs 62 are utilized, corresponding to several of the terminal members 20; and, desirably, each of said terminal members 20 is provided with such a thermosetting bonding agent sealing plug 62 fitted into an appropriate such hole 60 which reaches from the outside to said terminal member 20—however, according to the FIG. 7 sectional view, only one such hole 60 and one such thermosetting bonding agent sealing plug 62 fall in the plane of the drawing paper. A typical material from which the terminal members 20 are formed may be iron-nickel alloy type 42, and a typical material from which the switch base member 18 is formed may be PPS; in such an exemplary case, the material which is used for the thermosetting bonding agent sealing plug 62 may be single liquid type thermosetting epoxy resin.

The advantage of this shown construction is as follows. Since a heating process is typically involved when the thermosetting bonding agent sealing plug 62 is filled into the hole 60 of the switch base member 18, thereby a small gap is inevitably opened up at this time between the portion 20*a* of the terminal member 20 which is enclosed in the synthetic resin material of this switch base member 18 and said synthetic resin material of said switch base member 18 itself, due to the typical large difference between the coefficient of thermal expansion of the material of the terminal member 20 and the coefficient of thermal expansion of the material of the switch base member 18. At this time, therefore, the still relatively liquid material of said thermosetting bonding agent sealing plug 62 oozes into said small gap and effectively fills it. Thereafter this thermosetting bonding agent sealing plug 62 sets hard and thus effectively seals between the terminal member 20 and the switch base member 18.

Now, during the process of fixing such an electronic component at this one, when it is completely assembled to a printed circuit base board, typically a solder bath is used and the temperature of this solder bath may typically be about 260° C. or so. The soldering process typically takes about 10 seconds for completion and typically raises the temperatures of the portions of the terminal members 20 which are exposed outside the casing of the electronic component to about 210° C. or so, while typically raising the temperatures of the internally exposed fixed contact members 22 to about 180° C. or so. In other words, inevitably these terminal members 20 and also the proximate portions to said terminal members 20 of the material of the electronic component body 18 are considerably heated up during the above described soldering process. However, no substantial possibility can occur of soldering flux creeping into the interior of the electronic component body 18 through any gap that might open up between the material of the terminal member 20 and the material of the switch base member 18, because the material of the thermosetting bonding agent sealing plug 62 has already been infiltrated into any such gap. Accordingly, the intrusion of soldering flux or the like into the interior of this electronic component is prevented. This means, that there is no substantial likelihood of any problems occurring with the reliability of such an electronic component, due to problems with bad contacts or the like engendered by such soldering flux ingress. Thus, it is seen that this electronic component is well and effectively sealed and is not liable to lose its seal, even when its terminals are heated up as during soldering of said terminals to a printed circuit board. Further, this electronic component can maintain good performance without deterioration of its operational characteristics occurring due to the ingress of soldering flux and is not likely to suffer from poor contact performance.

THE SECOND PREFERRED EMBODIMENT

Figure 5:
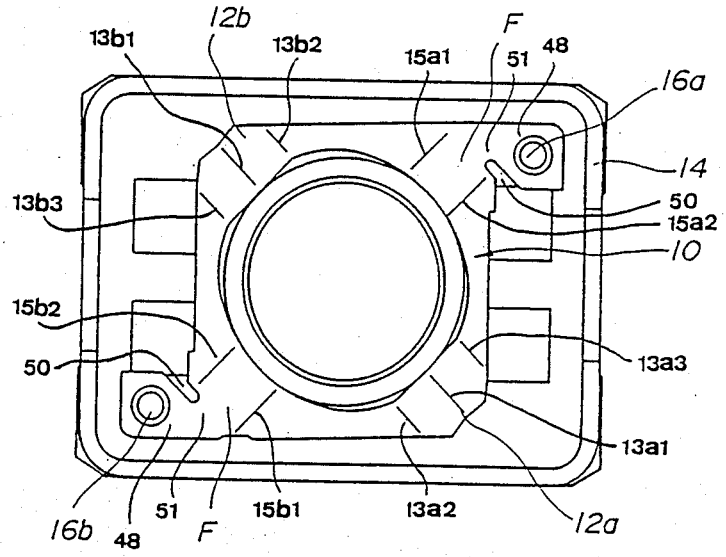

Next with regard to FIG. 5, the second preferred embodiment of the electronic component of the present invention will be described. It should be understood that, in FIG. 5, like reference symbols to reference symbols in previous figures relating to the first preferred embodiment correspond to like elements.

This second preferred embodiment differs from the first preferred embodiment described above, only in that the sheet spring member 10 is attached by the fixing pins 16*a* and 16*b* to the switch cover member 14, not by the use of thermal crimping as was the case in said first preferred embodiment, but by press fitting of said fixing pins 16*a* and 16*b* into the openings 52 of the mounting ear portions 48. Otherwise the construction is the same as in the first preferred embodiment, and accordingly the same advantages and benefits accrue as in this case of said first preferred embodiment.

THE THIRD PREFERRED EMBODIMENT

Figure 6:
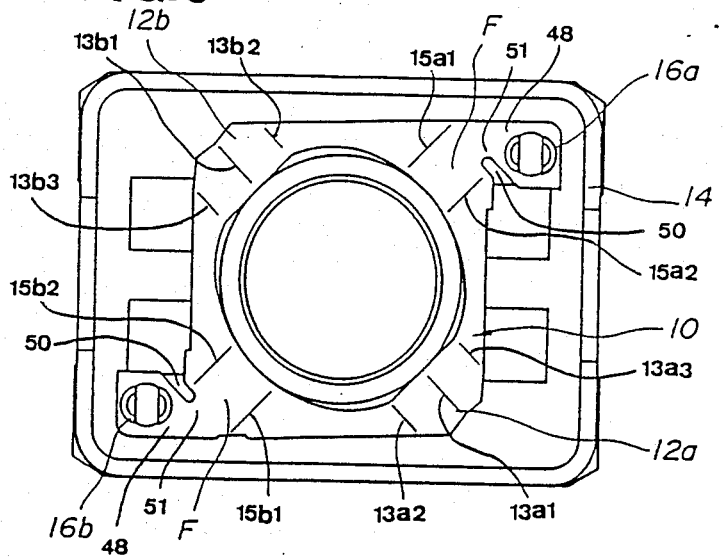
Figure 8:
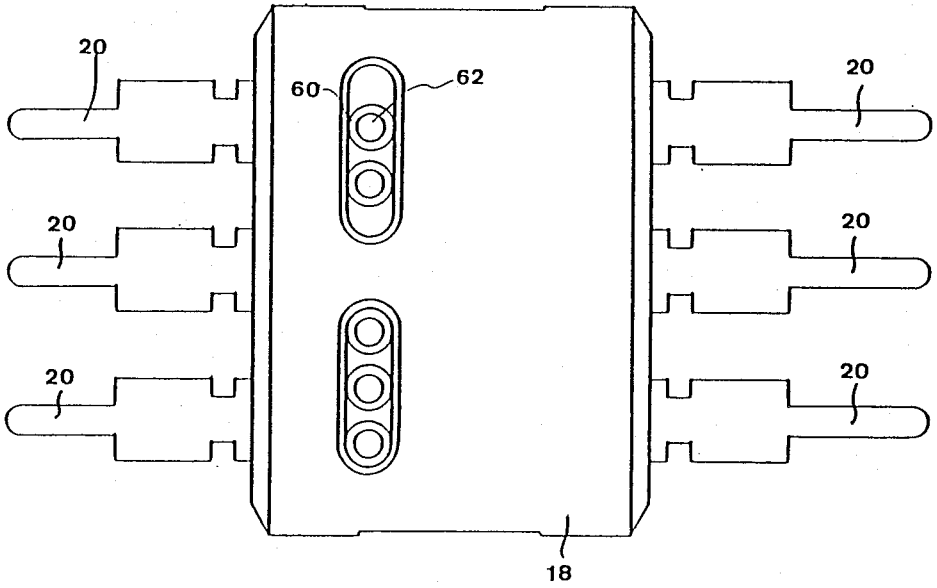

Next, with regard to FIG. 6, the third preferred embodiment of the electronic component of the present invention will be described. It should be understood that, in FIG. 6, like reference symbols to reference symbols in previous figures relating to the first and the second preferred embodiments correspond to like elements.

This third preferred embodiment differs from the first and the second preferred embodiments described above, only in that the sheet spring member 10 is attached by the fixing pins 16*a* and 16*b* to the switch cover member 14, not by the use of thermal crimping as was the case in said first preferred embodiment or by press fitting as was the case in said second preferred embodiment, but by snap fitting of the fixing pins 16*a* and 16*b* into the openings 52 of the mounting ear portions 48. Otherwise the construction is the same as in the first and the second preferred embodiments, and accordingly the same advantages and benefits accrue as in this case of said first and second preferred embodiments.

CONCLUSION

It is acceptable, according to the principle of the present invention, if the constructional details of the electronic component are varied, although the illustrated embodiments are considered to be preferred. Therefore, although the present invention has been shown and described in terms of the preferred embodiments thereof and with reference to the appended drawings, it should not be considered as being particularly limited thereby, since the details of any particular embodiment, or of the drawings, could be varied without, in many cases, departing from the scope of the present invention. Accordingly, the scope of the present invention is to be considered as being delimited, not by any particular perhaps entirely fortuitous details of the disclosed preferred embodiments, or of the drawings, but solely by the scope of the accompanying claims, which follow.

What is claimed is:

1. A rotary switch type electronic component, comprising:

(a) a casing;

(b) a disk shaped rotor member, rotatably disposed under said casing, and formed with first and second wavy cam patterns formed on the upper and lower surfaces, respectively, of said disk shaped rotor member;

(c) a contact mechanism, which is actuated by said second wavy cam pattern of said disk shaped rotor member as said disk shaped rotor member is rotated; and (d) a sheet spring disposed between said casing and said disk shaped rotor member, said sheet spring comprising:

(d1) two pressure portions;

(d2l ) a substantially flat portion, intermediate between said two pressure portions, which is stressed so as to press said two pressure portions against said first wavy cam pattern formed on said disk shaped rotor member as said disk shaped rotor member is rotated, for providing detent action of said disk shaped rotor member to actuate said contact mechanism; and

(d3) a fixing portion, fixed to said casing, and proximate and connected to said substantially flat portion.

2. An electronic component according to claim 1, wherein said fixing portion of said sheet spring is connected to said substantially flat portion thereof by a narrowed portion.

3. An electronic component according to claim 2, wherein a notch is defined on one side of said narrowed portion of said sheet spring between said fixing portion thereof and said substantially flat portion thereof.

4. An electronic component according to claim 1, wherein said fixing portion is formed with an aperture by which it is fixed to said casing.

5. An electronic component according to claim 1 or claim 4, wherein said fixing portion is fixed to said casing by thermal crimping.

6. An electronic component according to claim 1 or claim 4, wherein said fixing portion is fixed to said casing by press fitting.

7. An electronic component according to claim 1 or claim 4, wherein said fixing portion is fixed to said casing by snap fitting.

8. A rotary switch type electronic component, comprising:

(a) a casing;

(b) a disk shaped rotor member, rotatably disposed under said casing, are formed with first and second wavy cam patterns formed on the upper and lower surfaces, respectively, of said disk shaped rotor member;

(c) a contact mechanism, which is actuated by said second wavy cam pattern of said disk shaped rotor member as said disk shaped rotor member is rotated; and (d) a sheet spring, disposed between said casing and said disk shaped rotor member, said sheet spring comprising:

(d1) two pressure portions;

(d2) two substantially flat portions, each intermediate between said two pressure portions, which are stressed so as to press said two pressure portions against said first wavy cam pattern formed on said disk shaped rotor member as said disk shaped rotor member is rotated, for providing detent action of said disk shaped rotor member to actuate said contact mechanism; and (d3) two fixing portions, each fixed to said casing and each proximate and connected to a corresponding one of said substantially flat portions.

9. An electronic component according to claim 8, wherein said sheet spring is generally ring shaped with a generally circular interior outline and a generally square exterior outline, and said two pressure portions thereof are constituted by a pair of two diagonally opposed corner portions thereof which are creased so as to define projections opposing said first wavy cam pattern formed on said disk shaped rotor member, while said two substantially flat portions thereof are constituted by the other pair of two diagonally opposed corner portions thereof which are creased so as to press said two pressure portions thereof against said first wavy cam pattern formed on said disk shaped rotor member.

10. An electronic component according to claim 8 or claim 9, wherein said fixing portions of said sheet spring are connected to said substantially flat portions thereof by narrowed portions.

11. An electronic component according to claim 10, wherein notches are defined on the one sides of said narrowed portions of said sheet spring between said fixing portions thereof and said substantially flat portions thereof.

12. An electronic component according to claim 8, wherein each of said fixing portions is formed with an aperture by which it is fixed to said casing.

13. An electronic component according to claim 9, wherein each of said fixing portions is formed with an aperture by which it is fixed to said casing.

14. An electronic component according to any one of claims 8, 9, 12, or 13, wherein said fixing portions are fixed to said casing by thermal crimping.

15. An electronic component according to any one of claims 8, 9, 12, or 13, wherein said fixing portions are fixed to said casing by press fitting.

16. An electronic component according to any one of claims 8, 9, 12, or 13, wherein said fixing portions are fixed to said casing by snap fitting.

* * * * *